US012415671B2

(12) United States Patent
Østergaard

(10) Patent No.: US 12,415,671 B2
(45) Date of Patent: Sep. 16, 2025

(54) PACKAGING FOR ROOF WINDOW INSTALLATION PRODUCTS, A PACKED KIT OF WINDOW INSTALLATION PRODUCTS, AND THE USE OF A PACKAGING FOR ROOF WINDOW INSTALLATION PRODUCTS

(71) Applicant: VKR Holding A/S, Hørsholm (DK)

(72) Inventor: Leif Schack Østergaard, Horsens (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 17/909,808

(22) PCT Filed: Mar. 10, 2021

(86) PCT No.: PCT/DK2021/050078
§ 371 (c)(1),
(2) Date: Sep. 7, 2022

(87) PCT Pub. No.: WO2021/180288
PCT Pub. Date: Sep. 16, 2021

(65) Prior Publication Data

US 2024/0208717 A1 Jun. 27, 2024

(30) Foreign Application Priority Data

Mar. 10, 2020 (DK) ..... PA 2020 70162

(51) Int. Cl.
*B65D 85/48* (2006.01)
*B65D 5/42* (2006.01)
*B65D 5/46* (2006.01)

(52) U.S. Cl.
CPC ..... *B65D 85/48* (2013.01); *B65D 5/4225* (2013.01); *B65D 5/46* (2013.01)

(58) Field of Classification Search
CPC ..... B65D 5/42; B65D 5/4225; B65D 5/46; B65D 5/46072; B65D 5/4608; B65D 5/46088
See application file for complete search history.

(56) References Cited

U.S. PATENT DOCUMENTS 1,741,655 A 12/1929 Reichel
2,167,947 A 8/1939 Hayes
(Continued)

FOREIGN PATENT DOCUMENTS

DE 102016114011 A1 * 2/2017 ..... B65B 23/20
EP 3575509 12/2019
(Continued)

OTHER PUBLICATIONS

Danish Search Report dated Oct. 5, 2022 issued in Danish Application No. PA2020 70162 (nine pages).
(Continued)

*Primary Examiner* — Nathan J Newhouse
*Assistant Examiner* — Phillip D Schmidt
(74) *Attorney, Agent, or Firm* — Merek, Blackmon & Voorhees, LLC

(57) ABSTRACT

A packaging for roof window installation products it disclosed. It packaging comprises a folded sheet member having a bottom section defining a first plane, four side sections and a top section, said sections together defining an inner room and first outer dimensions of the packaging, in the assembled state. The packaging comprises at least one flange and at least one handle, each being movable between a first position, where it extends substantially in parallel with at least one of said sections and adjacent to said at least one section, and a second position, where it extends beyond the first outer dimensions. Said at least one flange is configured for engagement with the roof structure when in the second
(Continued)

position, and said handle is configured for carrying the packaging when in the second position. A use of a packaging for window installation products is also disclosed.

19 Claims, 5 Drawing Sheets

(56) References Cited

U.S. PATENT DOCUMENTS

| | | | | |
|---|---|---|---|---|
| 4,134,534 | A * | 1/1979 | Scott | B65D 5/46096 229/117.22 |
| 5,779,048 | A | 7/1998 | Dunn | |
| 6,604,631 | B2 * | 8/2003 | Evans | B65D 5/42 206/320 |
| 6,666,332 | B1 * | 12/2003 | DeWolf | B65D 5/422 206/45.28 |
| 8,857,642 | B2 * | 10/2014 | Liebowitz | B65D 5/029 229/117.22 |
| 9,914,582 | B2 * | 3/2018 | Jørgensen | B65D 85/48 |
| 2004/0099721 | A1 | 5/2004 | Leapman | |
| 2006/0283928 | A1 | 12/2006 | Walsh et al. | |
| 2011/0036749 | A1 | 2/2011 | Jacobsson | |
| 2014/0027553 | A1 * | 1/2014 | Page | B65H 23/06 242/159 |
| 2019/0112125 | A1 * | 4/2019 | Goodrich | B65D 5/42 |

FOREIGN PATENT DOCUMENTS

| | | | | |
|---|---|---|---|---|
| EP | 3575509 | A1 * | 12/2019 | B25H 7/00 |
| JP | 2002002685 | | 1/2002 | |
| WO | WO-9626117 | A1 * | 8/1996 | B65D 5/001 |
| WO | WO 2009/093940 | | 7/2009 | |
| WO | WO 2013/050041 | | 4/2013 | |
| WO | WO2017163273 | | 9/2017 | |

OTHER PUBLICATIONS

International Search Report dated May 27, 2021 issued in connection with International Application No. PCT/DK2021/050078, 2 pages.

Written Opinion dated Feb. 1, 2022 issued in connection with International Application No. PCT/DK2021/050078, 6 pages.

International Preliminary Report on Patentability dated Apr. 13, 2022 issued in connection with International Application No. PCT/DK2021/050078, 10 pages.

U.S. Appl. No. 17/908,961, filed Sep. 2, 2022.

* cited by examiner

PACKAGING FOR ROOF WINDOW INSTALLATION PRODUCTS, A PACKED KIT OF WINDOW INSTALLATION PRODUCTS, AND THE USE OF A PACKAGING FOR ROOF WINDOW INSTALLATION PRODUCTS

A packaging for roof window installation products, a packed kit of window installation products, and the use of a packaging for roof window installation products The present invention relates to a packaging for roof window installation products, said packaging comprising a folded sheet member having a bottom section defining a first plane, four side sections and a top section, said sections together defining an inner room and first outer dimensions of the packaging in the assembled state.

The packaging can contain different roof window installation products for use when installing roof windows, flat roof windows, skylights or the like, such as flashing kits, mounting brackets, insulation, underroof collars, vapour barrier collars and like components to be used during mounting of windows. The packaging may also be used for roof window related products, such as roller shutters, shades etc.

The content of the packaging may be used during several steps or throughout the roof window installation, therefore the packaging often needs to be placed on the roof for a period of time while the content of it is in use. In this period of time, the packaging may move on the roof e.g. due to weather conditions such as wind, gust, or it e.g. can slide downwards due to the inclination of the roof structure and gravity. A displacement of the packaging during window installation, due to movement, can cause errors, make the content of the packaging less accessible, and/or delay the installation of the window e.g. if a person installing a window has to move around on the roof to collect the content of the packaging or reposition the packaging closer to the window when the content has to be used.

In another perspective, a packaging moving around on the roof may pose a safety risk for person(s) mounting the window, and for person(s) beneath the roof e.g. if the packaging or some of its content slides off an inclined roof.

The outer dimensions of packages for roof window installation products, which are normally rectangular and quite long with a length 2-3 times larger than its width, often makes it difficult for the person installing the window to handle, carry and place them on a roof. The outer dimensions may limit the person installing a window to only bring one packaging on to the roof at a time, even though more are needed. The dimensions of the packaging may also increase the risk of errors, as it is difficult for window installers to move it around and arrange it on the roof in a safe way.

The above-mentioned problems particularly apply if the packaging is handled by a person having little or no experience, and consequently the risk of errors is relatively high.

To decrease the risk of errors, information on the outside of the packaging related to roof window installation and instructions included inside the packaging has been improved over the years, whenever problems have been discovered. Meanwhile, the handling of the packaging itself has, in contrast, remained virtually unchanged and the improvements of the packaging that have been made have been focusing on optimizing the use of the packaging materials, either for environmental or economic reasons, on adapting the sizes and shapes to meet storage requirements, or on the unpacking to improve the user experience as seen for example in the applicant's international patent application WO2013050041.

It is therefore the object of the invention to provide a packaging for roof window installation products having improved handleability, particularly when working on inclining roof structures.

In a first aspect of the invention, this is achieved with a packaging for roof window installation products of the kind mentioned in the introduction which is furthermore characterised in that said packaging has a first configuration, and a second configuration in which the packaging is configured to rest on an inclining roof structure, where the packaging comprises at least one flange being movable between a first position, where it extends substantially in parallel with at least one of said sections and adjacent to said at least one section, and a second position, where it extends beyond the first outer dimensions, said flange being configured for engagement with the roof structure when in the second position, and where the packaging comprises at least one handle being movable between a first position, where it extends substantially parallel with and adjacent to one of the side sections, and a second position, where it extends beyond the first outer dimensions, said handle being configured for carrying the packaging when in the second position.

In the first configuration of the packaging the at least one flange and the at least one handle are in their first positions so that the first outer dimensions are substantially the same as for a prior art packaging for roof window installation products having an inner room with generally the same dimensions. This means that existing systems for transport, storage and unpacking can be used for the packaging according to the present invention, without adjustments, and thus makes it easily adoptable in the existing systems.

In the second configuration of the packaging the at least one flange is in its second position, which makes it possible for the installer of a window to let the packaging find support on and/or engage with the inclining roof structure. The at least one handle may remain in its second position after use or be moved back into its second position when no longer needed.

The engagement between the packaging and the roof structure can be achieved by the flange extending in parallel with and coming into contact with the roof structure to create friction between the flange and the roof structure surface, thus enlarging the area of friction between the packaging and the roof structure. This will reduce the risk of the packaging sliding off the roof. It is, however, also possible to fixate the flange to the roof structure by passing a fastener, such as a nail, a screw, or a clamp, through the flange into a roof structure element, such as a lath.

The engagement between the packaging and the roof structure can also be achieved by the flange extending into the roof structure, coming in contact with a roof structure element, such as a lath, a counter lath, a rafter, or an element extending towards the exterior and away from the roof structure surface, such as a vent or a window. The flange thus abuts on the roof structure element or extending element and keeps the packaging from moving in at least one direction.

The flange can come into engagement with the roof structure by extending beyond the first dimensions of a bottom section of the packaging, by extending beyond the first dimensions of the top section, or by extending beyond the first dimensions of a side section of the packaging. In this context first dimensions are to be understood as the dimensions when the packaging is its first configuration.

The flange can be substantially in parallel with, perpendicular to or angled relative to a roof structure element, e.g. a lath or a rafter, when in engagement, and hereby transfer force to the roof structure element. As an example, the flange can extend substantially perpendicular to the first plane, such that it extends into the roof structure and abuts a side surface of e.g. a lath in a roof structure. In this example, the contact between the flange and the side surface of the lath creates an engagement, where the lath supports the flange and thus the position of the packaging on the roof.

A plate-shaped flange having two major surfaces and engaging with a surface on a lath or the like by extending into the rood structure is preferably arranged with the major surfaces extending perpendicular to the surface of the lath.

The packaging according to the invention is particularly advantageous for use on roof structures having an inclination of 15-45 degrees, where the risk of the packaging sliding under the influence of gravity is high, but it is to be understood that it is not limited to this use. It may even provide advantages when used on a flat roof as one or more flanges may be used for elevating one side of the packaging so that the bottom sections is inclined, thereby potentially easing access to the interior of the packaging.

In one embodiment the flange, in the second position, finds support on the roof structure by extending, from any of the top, bottom or side sections of the packaging, in parallel with the first plane and beyond the first dimensions of the packaging. Here it may come in contact with a roof structure element e.g. roof felt, one or more laths and/or rafters, or find support on an element extending from the roof surface, such as a previously installed roof window or the like, and hereby improve the engagement between the packaging and the roof structure. As an example, the flange can extend from a side section substantially in parallel to the first plane, such that it abuts the exterior side of a lath in a roof structure. In this example the contact between the flange and the lath can support the position of the packaging through friction and/or distribution of force onto a larger area.

With the flange in the second position it may be possible for an installer to place the packaging in proximity to existing roof installations e.g. a previously installed window, and let it find support against that. After placement, the flange may help retain the packaging in position by transferring force from the packaging to the roof structure or elements on the roof. After or during use, pulling on the flange can be used to adjust the position of the packaging on the roof, thus potentially making it easy to reposition or remove the packaging from the roof. It will often be possible to return a flange to the first position in connection with moving the packaging, and subsequently bring it back into the second position when the packaging has been arranged in a new position, which will for example be relevant if the packaging contains installation product for use with two or more windows. A flange can also be returned to the first position or torn off the packaging in connection with removal of the packaging from the roof.

Thus, using the flange to position, retain, reposition, and remove the packaging from the roof, may improve the user experience through better handleability when compared to the prior art.

The handle is also intended for use in positioning, repositioning, and removing the packaging, not allowing the installer to easily carry the packaging but potentially also been helpful when needing to move a packaging resting on a roof structure. The handle can not only be used by persons or may also be used for attaching the packaging to a lifting device for lifting the packaging to a roof structure.

If the handle is provided at a side section of the packaging and extending in the first plane, two packages can be arranged back to back and with the handles in contact with each other, to allow a person to carry two or more packages at once in one hand.

The handle can be a part of the sheet of material or be attached to the packaging. The handle can be reinforced to improve its strength e.g. by comprising or being made up of a stronger material.

The handle can in the first position be produced to abut the packaging without any fastener and be folded to the second position to act as a handle.

The handle can be created by folding the sheet material to form a handle.

In some embodiments the packaging can have more than one handle to improve the accessibility of the handle, to allow lifting at two or more points at the same time, or to allow several persons and/or devices to lift the packaging together.

In an embodiment the handle can be multiple purpose, both acting as a handle for transportation and a flange, with any of the potential characteristics of a flange described above.

It is noted that whenever reference is made to “bottom” and “top”, “upwards” and “downwards” etc. these indications of direction is given with reference to the packaging resting on a roof structure or like surface in an intended orientation for opening. During storage and transportation, the packaging may be found in other orientations. The intended orientation for opening the packaging may for example be indicated by printed information in the packaging.

In some embodiments, the flange is made from a material and having dimension which allows a fastener such as a nail or screw or clamp to be passed through it, such that the flange can be fastened to the roof structure. The flange can have guides for such fasteners e.g. perforations in the material of the flange. The fastening of the packaging to the roof can help fixate it to the roof structure when in use, thus the safety of the packaging is further improved. In an embodiment the flange can have marks or perforated areas prepared for the fasteners, such areas allow for a visual identifying e.g. the laths whereto the packaging can be fastened.

In some embodiments, the flange can come in contact with more than one lath or other roof elements, thus the supporting function of the flange can be improved. The flange can come in contact with more than one roof element by e.g. having a larger surface area extending further in parallel with, away from and/or along the packaging. The flange can also extend from more than one section of the packaging, thus finding support on more than one side section and/or in the first plane. A flange can also comprise fold lines and/or separation lines allowing the user to only use part of the flange.

In some embodiments the outline of the flange can be rounded, triangular, squared or another geometrical shape, which allows for variation of the flange outline to accommodate packaging needs e.g. being less likely to be pushed opened by the content of the packaging, flange strengthening e.g. by rounding corners to improve the structural strength or conditions set by the roof structure e.g. a triangular shape can make it easier to identify the placement of a lath to add a fastener through the flange. Rectangular flanges will, however, often be preferred as they are structurally simple and provide potential contact surfaced extending in parallel with or perpendicular to other parts of the packaging.

Similar considerations apply to the handle, where, however, factors such as ergonomics and safety may play a larger role.

In some embodiments, the flange is part of at least one side section being arranged, in its first position, parallel to and adjacent with said side section and being arranged, in its second position, parallel with the first plane defined by the bottom surface and extending away from the inner room of the packaging. Such a flange on the side section, in its second position, increases the surface area in the first plane e.g. on the bottom surface. The flange in the second position can improve the area of friction or engage with a roof structure element to reduce the movement of the packaging on the roof structure.

In other embodiments, the flange is part of at least one side section being arranged, in its first position, parallel to and adjacent with said side section and being arranged, in its second position, substantially parallel with said section and extending away from the inner room of the packaging. A such flange on the side section, in its second position, increases the surface area perpendicular to the first plane e.g. on the side section surface.

In this embodiment the flange in the second position can engage with a roof structure element as described above. It can, however, also be used for elevating one end of the packaging in relation to the other, i.e. serving as a prop stand tilting/lifting the packaging relative to the plane of the roof structure so that an angle is created between the bottom surface and the roof structure. This may make window installation elements more accessible when installing a window and/or compensate wholly or partially for the inclination of the roof. In order to create an angle between the bottom surface and the roof structure, it is possible that the flange can engage with another part of the packaging, e.g. the lid, which can act as a self-supporting structure on a roof structure. An angling between the bottom surface and the roof structure may also be advantageous on flat roofs, where it may make window installation elements more accessible to the installer. A handle may be used in a similar manner.

In some embodiments, the at least one flange is a part of the bottom section being arranged, in its first position, parallel to and adjacent with the bottom section and being arranged, in its second position, extending outwards relative to the inner room defined by the packaging. A flange on the bottom surface can extend into the roof structure and come into engagement with a roof structure element e.g. a lath, where it can engage with an outer surface of said lath to transfer force to the lath and/or align the packaging with a roof structure element by tilting it as described above.

In some embodiments, the at least one flange, can be positioned at the joint between two sections, thus if the flange is perpendicular to one section it can extend from and increase the surface area of another section. In such embodiments, fold lines of the sheet material can be used to e.g. fold or support the flange.

In some embodiments, the flange can extend across a plurality of sections when in the first position, thus, potentially creating a larger flange that can improve the handleability of the packaging and e.g. be easier to fasten to the roof structure or create a larger opening in the packaging that e.g. can be used for installation purposes or potentially improve the accessibility to the content of the packaging.

In some embodiments, the flange can form part of a lid or like closure of the packaging e.g. where the folding of the flange from the first position to the second position opens the top of the box, while creating a flange for support. In such an embodiment it can be possible to use the flange to close the packaging again, or to divide the entire packaging into at least two smaller compartments. The lid or like closure of the packaging in such embodiments can be on the top section, the bottom section or any of the side sections. The lid can be part of a section, make up an entire section or be part of more than one section.

In some embodiments, the packaging can have more than one flange, e.g. two flanges on opposite side sections, two flanges at the bottom section, or a combination of flanges at different sections. The additional at least one flange can improve the possibility for supporting the packaging on the roof e.g. by engaging with a lath at multiple points or engaging with multiple laths. Having at least two flanges further allows the installer to use the most relevant flange(s) for the current installation e.g. if at least one of the flanges of the packaging is blocked by an element extending from the roof surface, such as a window, or to allow use of the flanges regardless of the distance between laths. The combination of at least one flange on a side section and one at the bottom section can create a synergy of advantages between the flanges e.g. by having a flange for structural support and a second for keeping the packaging in position or being fastened to a roof element, or a combination of any of these purposes.

Thus, having more than one flange can improve the flexibility, the fixation and the handleability of the packaging. The packaging can also have three, four, five, six or more flanges e.g. for better support, for flexible support around obstacles or to improve the handleability.

In some embodiments, the flange can form part of the sheet member and be folded out from the packaging potentially leaving an opening in the sheet member. The flange can in some cases also be moved inwards to create improved handling of the packaging.

The outline or a part a flange and/or handle can be prepared as a weakening and/or cut-out in the sheet member e.g. by perforation, cuttings, fold lines or thinner material. The flange and/or handle can be fixed to the first position by e.g. the package material, glue, tape or other fixation elements. The flange and/or handle can be released from the first position by e.g. being torn by hand, being cut, or removal of the fixation elements. In some embodiments, the fixating elements can be used to return the flange and/or handle to the first position after being in the second position. In an embodiment, the flange and/or handle can be made out of an outer layer of a two or more-layer packaging.

In some embodiments the flange and/or handle can be a separate member attached to the sheet member, extending substantially in parallel with and adjacent to the sheet member, or in line with the surface of the sheet member, replacing a section of the sheet member when in the first position. The flange and/or handle can comprise or substantially be made up of the same material as the sheet member or of a different material e.g. coated cardboard, wood, metal, paper or polymer to increase the stiffness, usability and/or stability. The attachment of the flange and/or handle to the sheet member can be through chemical compounds, e.g. glue or adhesive, can be with physical measures, e.g. clips, pins, or by other means for attachment, such as tape. Having an attached flange and/or handle eliminates the need to create a hole in the packaging when folding the flange and/or handle to the second position and, thus, potentially improves the structural strength of the packaging and prevents objects from falling out.

In some embodiments the sheet member of the packaging can comprise or be made up of paper, cardboard, corrugated cardboard, wood, metal, a polymer, or a combination of two or more materials. A sheet member of e.g. cardboard can be covered or coated with a different material such as laminate, which can improve the stability, stiffness, weather-shielding or strength of the packaging.

The utilisation of the packaging is in some embodiments described for a roof structure with laths to be covered with roof covering such as tiles, shingles, roofing board or such. The distance between laths in such roof structures can vary depending on geographic area, legislation, regulation or national traditions. These examples do not limit the possible use of the packaging for this type of roof structure, as a person skilled in the art would be able to adjust the use of the packaging to other types of roof structure.

A second aspect of the innovation relates to a packed kit of roof window installation products. The kit can contain roof window installation products such as flashing members, skirts, fasteners, and a packaging according to any of the embodiments. Such a kit can improve the efficiency of roof window instalment and can reduce the amount of errors, e.g. by supplying necessary elements for roof window installation in one unit on the roof, potentially with instructions about when to use what product, and how to install the roof window installation products.

A third aspect of the innovation relates to the use of the packaging for roof window installation products, said packaging comprising, a folded sheet member having a bottom section defining a first plane, four side sections and a top section, said sections together defining an inner room and first outer dimensions of the packaging, in the assembled state; wherein the use includes: moving at least one handle from a first position, where it extends substantially parallel with and adjacent to at least one of said sections, to a second position, where it extends beyond the first outer dimensions; using said handle for carrying the packaging when in the second position; and moving at least one flange from a first position, where it extends substantially in parallel with a least one of said sections and adjacent to said at least section, to a second position where it extends beyond the first outer dimensions of the packaging.

In one embodiment the at least one flange is brought into engagement with the roof structure during or after being moved to the second position.

In some embodiments, the use further includes attaching the flange to a roof structure with at least one fastener. An advantage of the combination of fastener and the flange is that it eliminates the need for installers to fasten the packaging through the bottom section potentially damaging the roof window installation products and/or missing the laths.

Embodiments and advantages described with reference to one embodiment of the invention also applies to the other unless otherwise stated.

BRIEF DESCRIPTION OF DRAWINGS

In the following description embodiments of the invention will be described with reference to the schematic drawings, in which.

DESCRIPTION OF EMBODIMENTS

Figure 1:
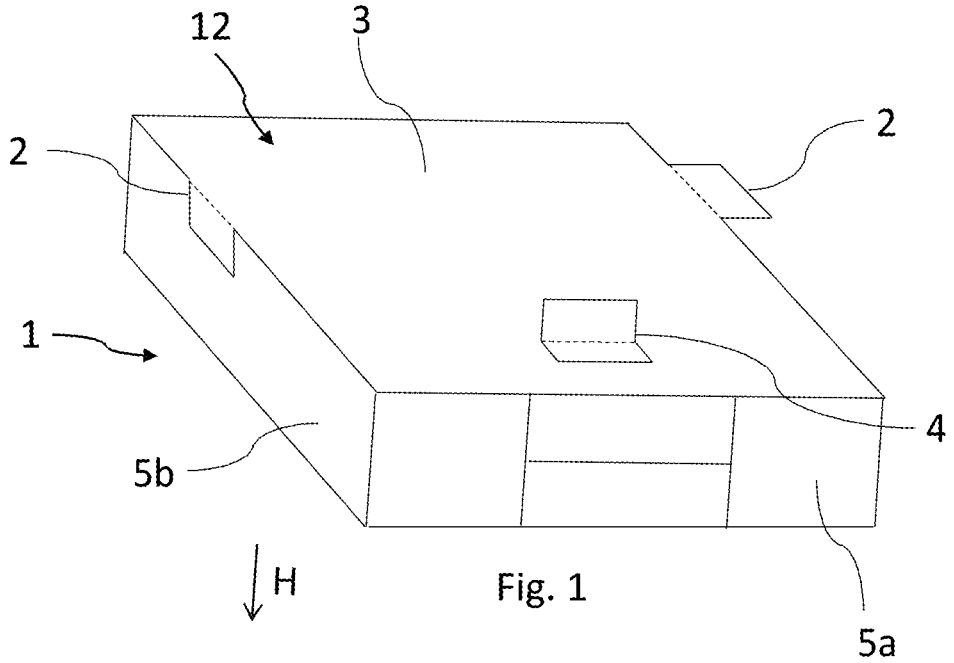
FIG. 1 is a perspective view of the packaging with depictions of different flanges.

A packaging 1 for roof window installation products is depicted in an upside-down orientation in FIG. 1. It is made from a sheet member 12 folded into a packaging with a rectangular bottom section 3 defining a first plane, and a top section opposite to the bottom section and in parallel with the first plane. Said bottom section being connected to four side sections 5*a*, 5*b*, in the embodiment depicted as two smaller side sections 5*a* and two larger side sections 5*b*. A height direction H substantially perpendicular to the bottom section from the bottom section 3 towards the top section. The bottom section 3, the top section, and the side sections 5*a*, 5*b* together define outer dimensions of the packaging.

In the embodiment in FIG. 1, the packaging is shown as being rectangular, but it could take the shape of a square or another geometrical figure, if folded differently.

The bottom section 3 is for facing and abutting a roof structure surface when the packaging is opened.

A rectangular flange 4 on the bottom section 3 at one of the smaller side sections 5*a* is in a second position extending substantially parallel with the smaller side section so that it may extend into and engage with a roof structure as will be described later. In its first position (not shown) the flange 4 formed part of the bottom section 3 of the packaging, and in its second position it has left a hole in the bottom section 3 of the packaging.

A larger side section 5*b* at the left-hand side of the packaging as seen in FIG. 1 has a rectangular flange 2 in a first position at the edge connecting the side section 5*b* with the bottom section 3. This flange 2 extends substantially parallel with said larger side section 5*b*, thus not changing the outer dimensions of the packaging.

At the opposite side section (to the right in FIG. 1) a similar rectangular flange 2 is shown in a second position. This flange extends substantially in the first plane, i.e. in parallel with and at a height level with the bottom section 3, thus enlarging the effective bottom surface of the packaging.

Figure 2:
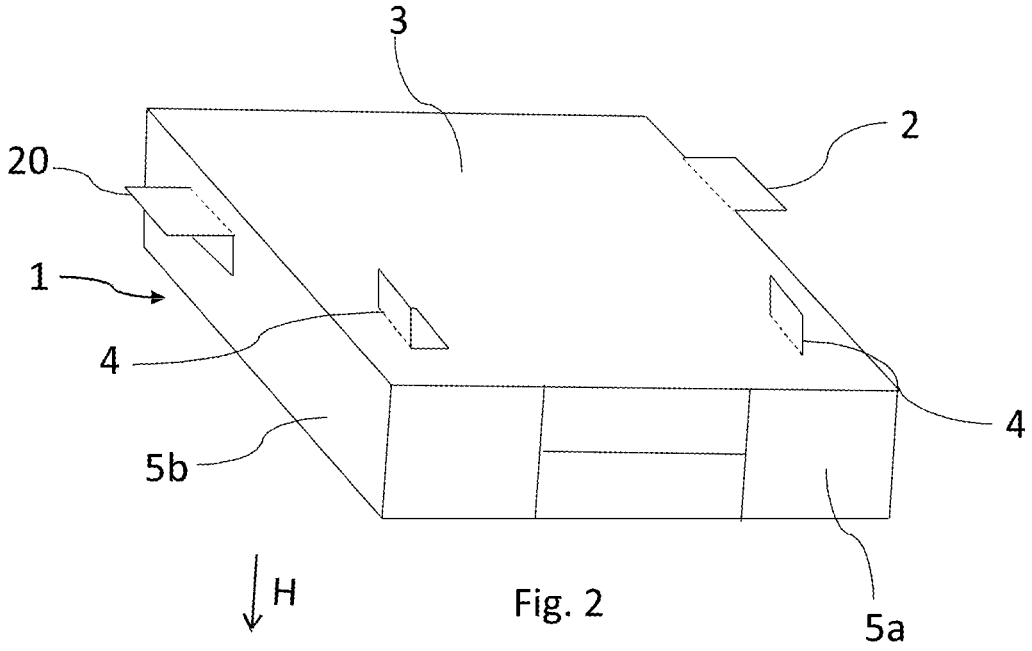
FIG. 2 is a perspective view of the packaging with flanges parallel with the longest side surface.

Referring to FIG. 2, another packaging is shown where the bottom section 3 has two rectangular flanges 4. These two flanges are shown in their second positions, extending in parallel to each other and to the larger side sections and perpendicular to the smaller side sections.

The left-hand flange 4 on the bottom section 3 in FIG. 2 has left a hole in the bottom section 3 of the packaging, whereas the right-hand flange 4 on the bottom section 3 in FIG. 2 is formed from a separate piece of material attached to the bottom surface 3 and has left the surface of the bottom section intact.

The right-hand side flange 2 in FIG. 2 is identical to the one described in FIG. 1, except for extending in parallel to the langer side section rather than to the smaller side section.

It is to be understood that all features of the packagings in FIGS. 2-6 are identical to those described with reference to FIG. 1 unless otherwise stated.

A left-hand side section 5*b* of the packaging 1 in FIG. 2 has a rectangular flange 20 in a second position, extending substantially parallel with the first plane with an offset in the height direction to the surface of the bottom section. This flange 20 is adapted for engaging with an element of/on a roof structure projecting above the exterior side of the roof structure.

Figure 3:
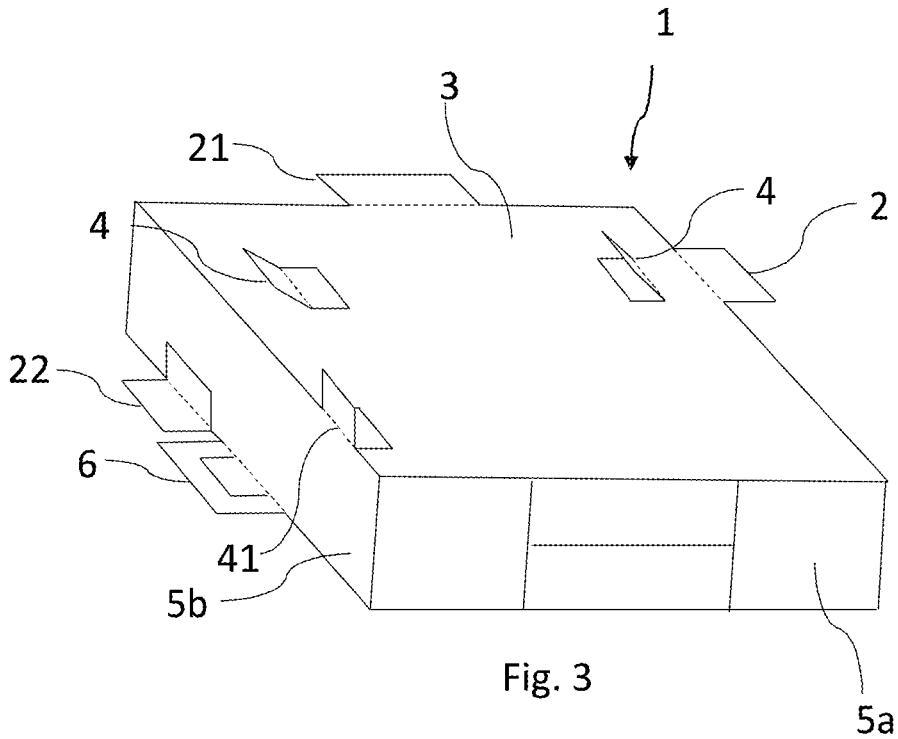
FIG. 3 is a perspective view of the packaging with flanges in different angles, and a handle acting as a flange.

Referring to FIG. 3, which shows a packaging identical to that in FIG. 1 except for the flanges, the bottom section 3 has three rectangular bottom flanges 4, 41, all shown in their second positions.

Two bottom flanges 4 are angled relative to the bottom section surface 3, whereof the right-hand flange is folded such that it is between its first position and being perpendicular to the bottom section, while the left-hand flange is folded beyond 90 degrees relative to the bottom section from its first position.

A third bottom flange 41 is at the edge connecting a larger side section 5*b* with the bottom section 3 and extends substantially in parallel with said larger side section 5*b*, thus enlarging the surface area of said larger side section surface.

FIG. 3 further shows a first, second and a third side flanges 2, 21, 22 in their second positions. The first side flange 21 is positioned at the edge connecting a smaller side section 5*a* with the bottom section 3, and the flange 21 extends in parallel with the bottom section, thus enlarging the bottom section surface. The second and third side flange 2, 22 are positioned at a first and a second larger side section, respectively, extending in parallel with the first plane. The third side surface flange 22 is at the top section thus enlarging the top section surface, and the third side surface 2 flange is at level with the bottom section 3 thus enlarging the bottom section surface as also described with reference to FIG. 1.

FIG. 3 further depicts a handle 6 at the larger side section 5*b* at the left side of the packaging. The handle in its second position being parallel with the first plane and at level with the top section. The handle being positioned at the top section surface of the packaging allows for an installer to carry two packages, back to back, in one hand at the same time. A similar advantage could be achieved with a handle at the bottom section.

Figure 4:
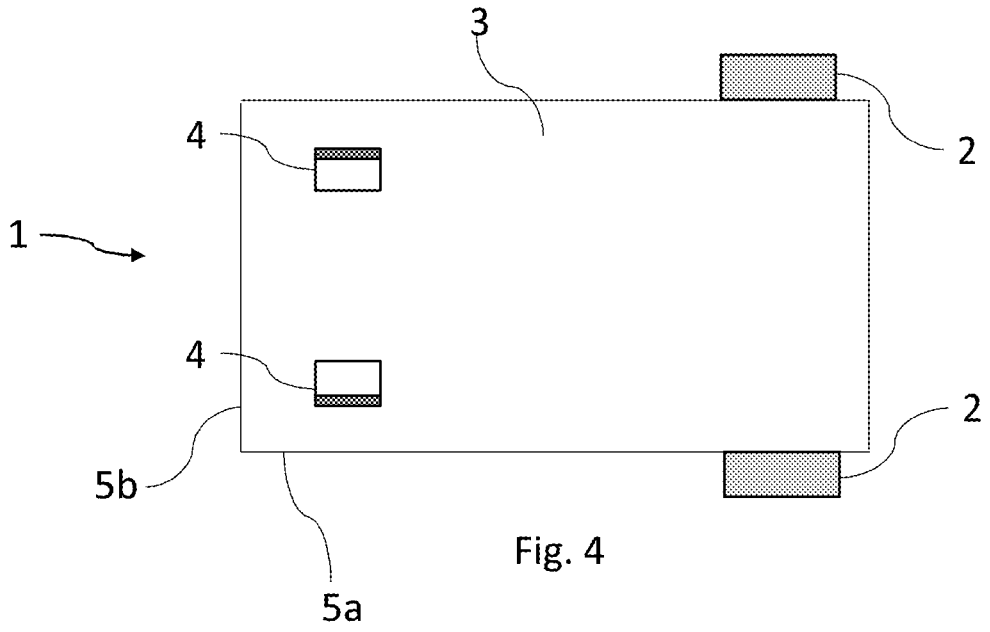
FIG. 4 is a bottom view of the packaging corresponding to FIG. 2, with the flanges in a second position.

FIG. 4 is a bottom view of a packaging 1 having a side flange 2 at each of the larger side sections 5*b* close to one of the smaller side sections as in FIG. 1 and two bottom 4 flanges at the bottom section extending in parallel with one of the larger side sections of the packaging resembling that in FIG. 2.

Figure 5:
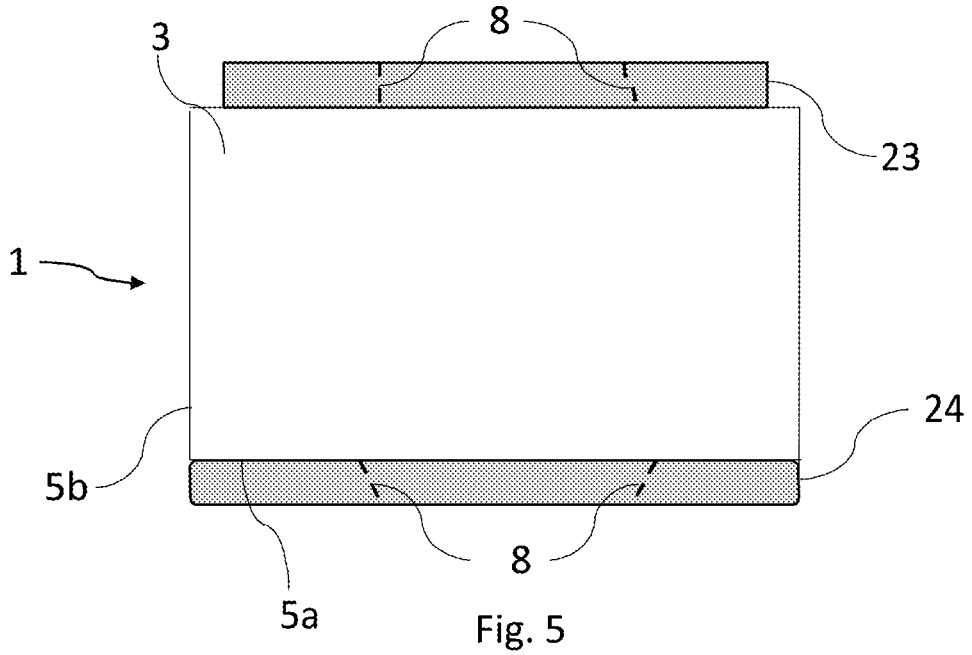
FIG. 5 is a bottom view of the packaging with elongated flanges and flange fold lines.

In FIG. 5 there is no bottom flanges on the bottom section. There are two elongated side flanges 23, 24 whereof one 23 extends along one of the larger side section of the packaging and one 24 extends along the other larger side section 5*b*. One side flange 24 extends along the entire length of the packaging from one smaller side section to the other, while the other is somewhat shorter but still extending over substantially the entire length. The corners of the side flanges 23, 24 in FIG. 5 are shown as being pointy or curved, respectively.

Fold and/or tear lines 8 on the side flanges 23, 24 allow installers to use only a part of the flange or to arrange sections of these flanges in different positions, for example arranging one section to extend into the roof structure and two sections to extend in parallel with the first plane and the roof structure. The fold and/or tear lines 8 can be linear or non-linear e.g. the fold and/or tear lines can be straight, they can be parallel to a side section, they can be angled to a side section or they can be curved.

Figure 6:
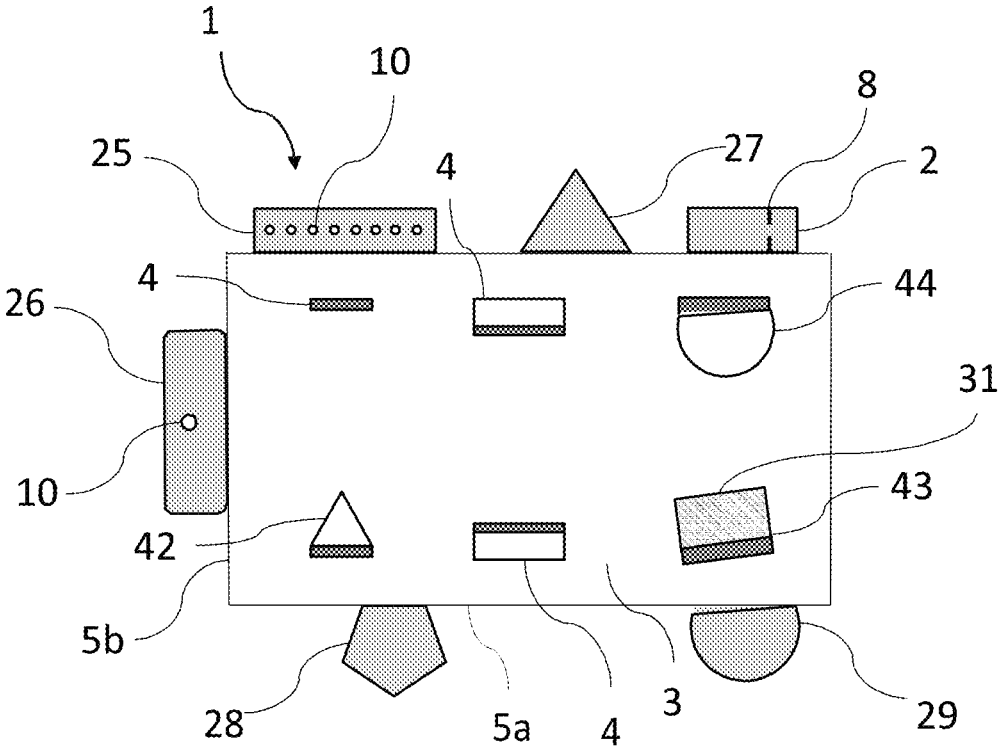
FIG. 6 is a bottom view of the packaging with flange shape variations and perforations for fasteners.

FIG. 6 shows a variation of bottom section flanges 4, 42-44, which vary in size, shape, placement and orientation relative to a side section. On the side sections of the packaging, a variety of side flanges 2, 25-29 are depicted of different, size, shape, placement and orientation. It is to be understood that this is only to illustrate many different possible embodiments of flanges and that they will not all be present on a real life packaging.

Two of the side flanges 25, 26 have perforation(s) 10 for e.g. fasteners to ease installation. The perforation 10 can be used to e.g. identify laths behind the flange and help installers fasten the packaging to a roof structure, by passing a nail, screw, or the like through the perforation into the roof structure. The perforation 10 can also be provided with a transparent material e.g. polymer to make it a see-through hole. The perforation 10 can be for identifying different parts of a roof structure and installments on it.

One of the flanges 2 has a fold line 8 for an installer to be able to use only part of the flange as describe with reference to FIG. 5.

The remaining flanges 27, 28, 29, 42, 43, 44 show different possible shapes.

One bottom flange 43 is provided by additional material being glued onto the bottom section 3 as indicated by the hatching 31 on the bottom surface.

Figure 7:
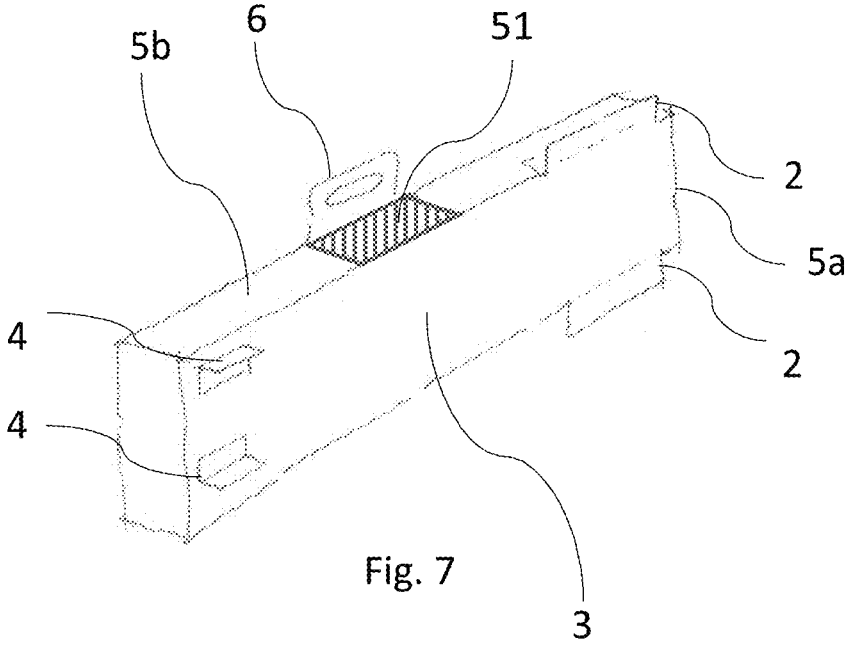
FIG. 7 is a perspective view drawing of the packaging with two side flanges, two bottom section flanges and a handle.

Referring to FIG. 7, a handle 6 in the second position is shown at the top section opposite the bottom section 3 and at one larger side section 5*b*. This handle is part of the outer material of the side section but has not left a hole in the packaging as the side section is double-layer. Thus, the handle in the second position reveals the second layer 51 of side section material.

The revealed second layer 51 of side section material can have information (not shown) printed on it, such as safety instructions, instructions on how to use the packaging for roof window installation products, and/or other instructions. Such instructions can be labelled, glued and/or printed on the packaging.

The packaging in FIG. 7 further has two side flanges 2 in second positions substantially parallel with the bottom section 3, thus enlarging the bottom surface. The bottom section has two flanges 4 in second positions extending in parallel with the larger side sections 5*b*.

Figure 8:
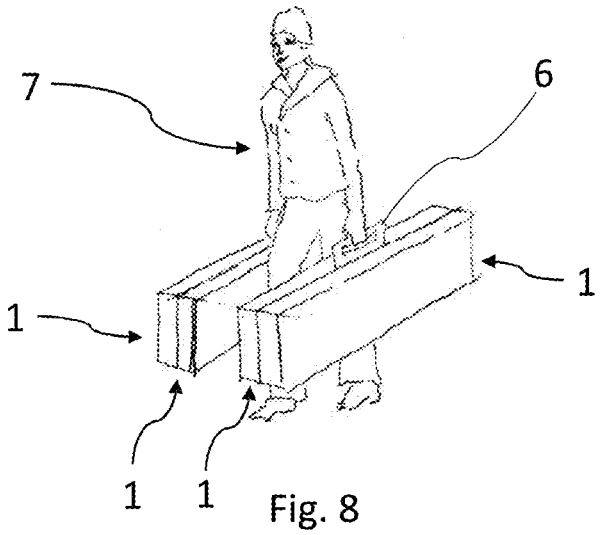
FIG. 8 shows is an installer carrying several packages in his hands.

In FIG. 8 packagings as the one shown in FIG. 7 is shown in use. A person 7 carries two packages 1 in each hand using the handles 6 in the second position, said packages being arranged with their top sections abutting each other. The position of the handle(s) 6 let the person 7 hold two packages in the same hand at the same time.

Figure 9:
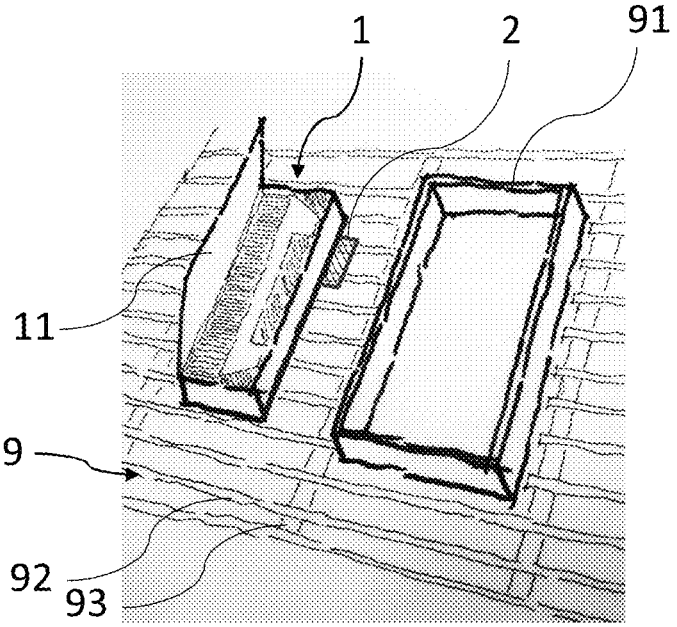
FIG. 9 is the packaging in use on an inclined roof structure next to a window.

In FIG. 9 the packaging 1 is in use on an inclined roof structure 9 next to a window opening and window frame 91. The bottom section (not visible) of the packaging 1 abuts the inclined roof 9, and the top section 11 of the packaging works as a lid, being open in a position almost parallel with one of the larger side sections. The lid may be able to be folded completely over so that part of the lid rests on the roof structure. One side flange 2 is seen on one of the larger side sections, and a similar flange may be found at the opposite larger side section, which is not visible, or at the smaller side sections. Furthermore, the bottom section may be provided with flanges, for example as shown in FIG. 7, which could be in engagement with one of the latches 92 or rafters 93 of the roof structure to keep the packaging in place as described above.

In the drawing all embodiments of the packaging 1 are shown in their second configuration in that at least one flange 2, 20-29, 4, 41-44 or handle 6 has been moved out to its second position. In the first configuration of the packaging, all flanges and handles extend along at least one of the top section 11, the bottom section 3, and the side sections 5*a*, 5*b* so that they are within the first outer dimensions of the packaging defined by these sections 3, 5*a*, 5*b*, 11. It is, however, to be understood that as a flange or a handle may be formed from a separate piece of material attached to the main body of the packaging, it may project a few millimetres above the main body. Likewise, a flange or a handle may project a few millimetres over an edge of the packaging to allow an installer to get a hold of it. This applies to all embodiment of the invention, including those not shown in the drawing.

LIST OF REFERENCE NUMERALS

1 Packaging for window installation products
11 Top section of a packaging
12 Sheet member
2 Flange positioned at one of the packaging's larger side sections at the height level of the bottom surface
20 Flange positioned at one of the packaging's larger side sections between the height of the bottom surface and the height of the top surface
21 Flange positioned at one of the packaging's smaller side sections
22 Flange positioned at a side section, at the intersection between two surfaces of the packaging
23 Elongated flange positioned at one of the packaging's sides stretching along most of a side section
24 Elongated flange positioned at one of the packaging's sides
25 Flange on a side section with a rectangular shape
26 Flange on a side section with a rounded rectangular shape
27 Flange on a side section with a triangular shape
28 Flange on a side section with a pentangular shape
29 Flange on a side section with a rounded shape
3 Bottom surface stretching along an entire side section
31 Hatched bottom surface area
4 Flange positioned at the bottom surface of the packaging in a second position
41 Flange positioned at the bottom surface, at the intersection between two surfaces of the packaging
42 Flange positioned at the bottom surface with a triangular shape
43 Flange positioned at the bottom surface not parallel with a side section
44 Flange positioned at the bottom surface with a rounded shape
5*a* Side section of the packaging, smaller
5*b* Side section of the packaging, larger
51 Hatched side section area
6 Handle on the packaging, which can act as a flange
7 Person
8 Tear/fold lines on a side flange
9 Inclined roof
91 Roof window frame
92 Lath
93 Rafter
10 Perforation(s) or transparent material
H Height

The invention claimed is:

1. A packaging for roof window installation products, said packaging comprising:

a folded sheet member having a bottom section defining a first plane, four side sections and a top section, said sections together defining an inner room and first outer dimensions of the packaging, in the assembled state;

said packaging has a first configuration and a second configuration, the second configuration being a configuration in which the packaging is configured to rest on an inclining roof structure;

the packaging having at least one flange being movable between a first position, wherein the at least one flange extends substantially in parallel with at least one of said sections and adjacent to said at least one of said sections, and a second position, wherein the at least one flange extends beyond the first outer dimensions, said at least one flange being configured for engagement with the inclining roof structure when in the second position and, wherein an outline of the at least one flange is one of: (i) a weakening in the material of the folded sheet member, and (ii) one or more cuts through the material of the folded sheet member, wherein the at least one flange includes a first flange that forms part of at least one side section when in its first position and is arranged, in its second position, parallel with the first plane defined by the bottom surface, and wherein the at least one flange includes a second flange that forms part of the bottom section being arranged, in its first position, parallel to and adjacent with the bottom section and being arranged, in its second position, extending outwards relative to the inner room defined by the packaging, the packaging comprises at least one handle being movable between a first position, wherein the at least one handle extends substantially parallel with and adjacent to at least one of said sections, and a second position, wherein the at least one handle extends beyond the first outer dimensions, said at least one handle being configured for carrying the packaging when in the second position, and one or more members for installing a roof window housed within the inner room, wherein the one or members includes one of the following: (i) flashing members, (ii) skirts and (iii) fasteners.

2. The packaging according to claim 1, wherein the outline of the at least one flange is a weakening in the material of the folded sheet member.

3. A packed kit of window installation products including flashing members, skirts and fasteners stored in a packaging according to claim 2.

4. The packaging according to claim 1, wherein the at least one flange has at least one perforation.

5. The packaging according to claim 1, wherein the at least one handle extends substantially parallel with and adjacent to one of the side sections when in the first position.

6. A packed kit of window installation products including flashing members, skirts and fasteners stored in a packaging according to claim 5.

7. The packaging according to claim 1, wherein the folded sheet member is made of paper, cardboard, corrugated cardboard, polymer or a combination of at least two materials.

8. A packed kit of window installation products including flashing members, skirts and fasteners stored in a packaging according to claim 1.

9. The packaging according to claim 1, wherein the outline of the first flange is a weakening in the material of the folded sheet member.

10. The packaging according to claim 1, wherein the first flange has at least one perforation.

11. The packaging according to claim 1, wherein the second flange has at least one perforation.

12. A method of providing a packaging for window installation products and configuring the packaging to assume an operational position, said method comprising:

providing a folded sheet member having a bottom section defining a first plane, four side sections and a top section, said sections together defining an inner room and first outer dimensions of the packaging, in the assembled state;

moving at least one handle from a first position, where the at least one handle extends substantially parallel with and adjacent to at least one of said sections, to a second position, where the at least one handle extends beyond the first outer dimensions so that the packaging can be transported to the operational position using the at least one handle, and moving at least one flange from a first position, where the at least one flange extends substantially in parallel with a least one of said sections and adjacent to said at least one of said sections, to a second position where the at least one flange extends beyond the first outer dimensions of the packaging to secure or position the packaging in the operational position engaging a portion of a roof and, wherein an outline of the at least one flange is one of: (i) a weakening in the material of the folded sheet member, and (ii) one or more cuts through the material of the folded sheet member, wherein the at least one flange includes a first flange that forms part of at least one side section when in its first position and is arranged, in its second position, parallel with the first plane defined by the bottom surface, and wherein the at least one flange includes a second flange that forms part of the bottom section being arranged, in its first position, parallel to and adjacent with the bottom section and being arranged, in its second position, extending outwards relative to the inner room defined by the packaging.

13. The method according to claim 12, wherein the at least one flange is brought into engagement with the roof structure during or after being moved to the second position.

14. The method according to claim 13, which further includes, attaching the at least one flange to a roof structure with at least one fastener.

15. The method according to claim 12, which further includes, attaching the at least one flange to a roof structure with at least one fastener.

16. The method according to claim 12, wherein the outline of the at least one flange is a weakening in the material of the folded sheet member.

17. The method according to claim 12, wherein the at least one handle extends substantially parallel with and adjacent to one of the side sections when in the first position.

18. A method of using a packaging for window installation products to install a roof window, said method comprising:

providing a packaging for window installation products in the form of a folded sheet member having a bottom section defining a first plane, four side sections and a top section, said sections together defining an inner room and first outer dimensions of the packaging, in the assembled state;

moving at least one handle from a first position, where the at least one handle extends substantially parallel with and adjacent to at least one of said sections, to a second position, where the at least one handle extends beyond the first outer dimensions so that the packaging can be transported to an operational position adjacent a roof window opening using the at least one handle, transporting the packaging using the handle to the operational position adjacent a roof window opening, moving at least one flange from a first position, where the at least one flange extends substantially in parallel with a least one of said sections and adjacent to said at least one of said sections, to a second position where the at least one flange extends beyond the first outer dimensions of the packaging to secure or position the packaging on the roof adjacent the roof window opening, wherein the at least one flange includes a first flange that forms part of at least one side section when in its first position and is arranged, in its second position, parallel with the first plane defined by the bottom surface, and wherein the at least one flange includes a second flange that forms part of the bottom section being arranged, in its first position, parallel to and adjacent with the bottom section and being arranged, in its second position, extending outwards relative to the inner room defined by the packaging, and opening the top section of packaging without altering an assembled orientation of the four side sections and an assembled orientation of the bottom section to allow an individual to remove one or more components from the inner room during installation of the roof window.

19. The method of claim 18, wherein an outline of the at least one flange is a weakening in the material of the folded sheet member.

* * * * *